US007955444B2

(12) United States Patent
Ariga et al.

(10) Patent No.: US 7,955,444 B2
(45) Date of Patent: Jun. 7, 2011

(54) HIGH STRENGTH STEEL SHEET AND METHOD FOR MANUFACTURING THE SAME

(75) Inventors: Tamako Ariga, Kawasaki (JP); Takeshi Yokota, Kawasaki (JP); Akio Kobayashi, Kawasaki (JP); Kazuhiro Seto, Kawasaki (JP)

(73) Assignee: JFE Steel Corporation, Tokyo (JP)

( * ) Notice: Subject to any disclaimer, the term of this patent is extended or adjusted under 35 U.S.C. 154(b) by 391 days.

(21) Appl. No.: 11/989,182

(22) PCT Filed: Aug. 3, 2006

(86) PCT No.: PCT/JP2006/315772

§ 371 (c)(1),
(2), (4) Date: Jan. 22, 2008

(87) PCT Pub. No.: WO2007/018246

PCT Pub. Date: Feb. 15, 2007

(65) Prior Publication Data

US 2009/0095381 A1 Apr. 16, 2009

(30) Foreign Application Priority Data

Aug. 5, 2005 (JP) ..... 2005-228546

(51) Int. Cl.

| | |
|---|---|
| ***C21D 8/02*** | (2006.01) |
| ***C22C 38/14*** | (2006.01) |
| ***C22C 38/24*** | (2006.01) |

(52) U.S. Cl. ..... 148/328; 148/320; 148/602; 148/531; 148/533; 428/659; 428/653

(58) Field of Classification Search ..... 148/320, 148/328, 334, 602, 531, 533; 428/659, 653; 420/124, 126, 127

See application file for complete search history.

(56) References Cited

FOREIGN PATENT DOCUMENTS

| | | | |
|---|---|---|---|
| JP | 06-172924 | A | 6/1994 |
| JP | 06-2003511 | A | 7/1994 |
| JP | 2002-322539 | A | 11/2002 |
| JP | 2003-089848 | A | 3/2003 |
| JP | 2004-143518 | A | 5/2004 |
| JP | 2005-002406 | A | 1/2005 |
| JP | 2005-120430 | A | 5/2005 |

OTHER PUBLICATIONS

Machine-English translation of Japanese patent 2003-089848, Mar. 28, 2003, Shiozaki Takeshi et al.*

* cited by examiner

*Primary Examiner* — Deborah Yee
(74) *Attorney, Agent, or Firm* — Holtz, Holtz, Goodman & Chick PC

(57) ABSTRACT

A high tensile steel sheet having 980 MPa or higher tensile strength with excellent elongation and stretch-flange formability, suitable for the press-forming of complex cross sectional shape such as automobile parts, is manufactured by adjusting the steel to consist essential of a ferrite single phase structure, to precipitate carbide containing Ti, Mo, and V, of smaller than 10 nm of average particle size, in dispersed state, and to have an average composition of the carbide containing Ti, Mo, and V satisfying [V/(Ti+Mo+V)≧0.3 (atomic ratio].

14 Claims, 2 Drawing Sheets

HIGH STRENGTH STEEL SHEET AND METHOD FOR MANUFACTURING THE SAME

This application is the United States national phase application of International Application PCT/JP2006/315772 filed Aug. 2, 2006.

TECHNICAL FIELD

The present invention relates to a high tensile strength steel (HSS) sheet having excellent formability and being suitable for the base material of automobile parts, and to a manufacturing method thereof.

BACKGROUND ART

Steel sheets for automobile face strong request of gauge down by using HSS in view of improving fuel consumption for the environmental conservation. Since many of automobile parts are fabricated by press forming into complex shapes, there are requested materials having high strength and having both high elongation and stretch-flange formability, both of which are indexes of formability.

Steel sheets in recent years increase in the strength than ever, and those having higher than 980 MPa of strength are wanted. In addition, from the point of further weight reduction, the steel sheets are decreasing their thickness, and the request for thin gauge steel sheets of 2.5 mm or smaller thickness increases.

There are proposed various kinds of that type of steel sheets. For example, JP-A-6-172924, (the term "JP-A" referred to herein signifies the "Unexamined Japanese Patent Application Publication"), proposes a steel sheet having excellent stretch-flange formability, in which a bainitic ferrite structure having high dislocation density is formed. Since, however, the steel sheet contains a bainitic ferrite structure of high dislocation density, it has a drawback of poor elongation. In addition, to form the bainitic ferrite, high cooling rate on a runout table is unavoidably necessary. When manufacturing thin gauge steel sheets, therefore, a problem of prevention of meanders of strip on the runout table arises during manufacturing thin gauge sheets so that the technology is not suitable for manufacturing thin gauge sheets of 2.5 mm or smaller thickness.

JP-A-6-200351 proposes a steel sheet having excellent stretch-flange formability giving 70 kg/cm$^2$ or higher tensile strength by adjusting most part of the microstructure to polygonal ferrite and by precipitation strengthening mainly by TiC and solid-solution strengthening. It is, however, difficult to attain high tensile strength of 980 MPa or more by the widely known precipitate used in the steel sheet.

That is, when a large quantity of Ti is added to increase the tensile strength for the purpose of attaining 980 MPa or more, coarse precipitate likely forms, and the desired strength cannot be attained. In addition, increased adding quantity of Ti increases the necessary slab-heating temperature for dissolving TiC into the form of solid solution, thus it tends to become difficult to manufacture the steel sheet by an ordinary apparatus.

JP-A-2004-143518 proposes a hot-rolled steel sheet which contains ferrite having 1 to 5 μm of average grain size as the main phase and which is precipitation-strengthened by carbonitride of V having 50 nm or smaller average particle size. To obtain fine V precipitate, however, there is generally needed the coiling at a low temperature of 550° C. or below. As a result, increase in the quantity of precipitate becomes difficult, and the strengthening has a limitation. Therefore, with the steel sheet, combination with grain refinement strengthening of ferrite, described above, is required to achieve higher tensile strength.

In the technology described in JP-A-2004-143518, however, the refinement of ferrite grains needs, in the finish rolling step, the rolling of sheet at $Ar_3$ transformation point or higher temperature at a rolling stand before the last stand in the tandem rolling mill row, and then cooling the sheet to a temperature of "$Ar_3$ transformation point—50° C." or below at an average cooling rate of 50° C./s or more, followed by rolling to 20% or smaller reduction at the final stand. With an ordinary manufacturing line, however, realization of that manufacturing condition is difficult.

Furthermore, since the steel sheet allows the formation of pearlite and the like, elongation and stretch-flange formability may be deteriorated.

As the technology to obtain an ultrahigh tensile steel sheet, JP-A-2002-322539 and JP-A-2003-89848 disclose a technology to manufacture ultrahigh tensile steel sheet having both excellent elongation and stretch-flange formability by dispersing fine carbide consisting of C, Ti, and Mo into the ferrite single phase. Similar to the technology disclosed in JP-A-6-200351, however, when a large quantity of C and Ti is added to obtain 980 MPa or higher tensile strength, normal slab-heating temperatures (about 1150° C. to about 1250° C.) cannot completely dissolve TiC and other substances precipitated in the slab, in some cases. That is, to completely dissolve TiC and other substances for attaining high strength, further high temperature is required, which makes manufacturing the steel difficult in some cases, and, even if the manufacturing is conducted, a heavy load is applied to the manufacturing apparatus.

DISCLOSURE OF THE INVENTION

Problems to be Solved by the Invention

The present invention has been perfected to solve the above problems. An object of the present invention is to provide a high tensile steel sheet giving 980 MPa or higher strength, being suitable for the press-forming of complex cross sectional shape, such as automobile parts, giving both excellent elongation and stretch-flange formability, which are indexes of formability, and allowing easily manufacturing the steel compared with the related art. Another object of the present invention is to provide a method for manufacturing the high tensile steel sheet with reduced load on the manufacturing apparatus.

Means to Solve the Problems

To achieve the above objects, the inventors of the present invention carried out detail studies, and derived the following findings.

(a) With a microstructure of low dislocation density and of being strengthened by refined precipitate, the total property of strength and elongation improves.

(b) With a microstructure consisting essentially of a ferrite single phase structure and being strengthened by refined precipitate, the total property of strength and elongation improves.

(c) With the addition of C, Ti, Mo, and V, and further with adequate control of the balance of the addition between them, the composite carbide made of those elements finely precipitates.

(d) With a reduced percentage of V in the composite precipitate, the precipitate becomes coarse, thus both the elongation and the stretch-flange formability decrease.

(e) Compared with the steel being added only by Ti and Mo, the steel being further added by V dissolves carbide at lower temperature, thereby attaining efficiently the fine precipitate which enhances the strengthening of steel.

The present invention has been perfected based on these findings, and the present invention provides following (1) to (7).

(1) The high tensile steel sheet consisting essentially of a ferrite single phase structure, having excellent formability giving 980 MPa or higher tensile strength, wherein a carbide containing Ti, Mo, and V, and having smaller than 10 nm of average particle size precipitates in dispersed state (i.e. dispersed in ferrite grains), and the carbide containing Ti, Mo, and V has an average composition satisfying [V/(Ti+Mo+V)≧0.3], which Ti, Mo, and V are expressed by atomic %.

(2) The high tensile steel sheet according to (1), wherein the average composition of the carbide satisfies a=0.6 to 1.4, b=0.6 to 1.4, and c=1.4 to 2.8, while a+b+c=4, where a:b:c is the atomic ratio of Ti:Mo:V.

(3) The high tensile steel sheet according to (1) or (2), having excellent formability giving 980 MPa or higher tensile strength, containing more than 0.06% and not more than 0.24% C, 0.3% or less Si, 0.5 to 2.0% Mn, 0.06% or less P, 0.005% or less S, 0.06% or less Al, 0.006% or less N, 0.05 to 0.5% Mo, 0.03 to 0.2% Ti, more than 0.15 and not more than 1.2% V, by mass, and balance of Fe and inevitable impurities, and having a composition in which the content of C, Ti, Mo, and V satisfies the formula (I), $$0.8 \leqq (C/12)/\{(Ti/48)+(Mo/96)+(V/51)\} \leqq 1.5 \quad (I)$$

where, C, Ti, Mo, and V designate % by mass of each of them.

(4) The high tensile steel sheet according to any of (1) to (3), having excellent formability, wherein the steel sheet is a thin gauge hot-rolled steel sheet having 2.5 mm or smaller sheet thickness.

(5) The high tensile steel sheet according to any of (1) to (4), having excellent formability, wherein the steel sheet has a hot-dip galvanized (including galvannealed) film thereon.

(6) A method for manufacturing high tensile steel sheet having excellent formability giving 980 MPa or higher tensile strength, having the step of hot-rolling a steel slab containing more than 0.06% and not more than 0.24% C, 0.3% or less Si, 0.5 to 2.0% Mn, 0.06% or less P, 0.005% or less S, 0.06% or less Al, 0.006% or less N, 0.05 to 0.5% Mo, 0.03 to 0.2% Ti, more than 0.15 and not more than 1.2% V, by mass, and balance of Fe and inevitable impurities, and having a composition in which the content of C, Ti, Mo, and V satisfies the formula (I), under a condition of 880° C. or higher finishing temperature and 570° C. or higher coiling temperature, $$0.8 \leqq (C/12)/\{(Ti/48)+(Mo/96)+(V/51)\} \leqq 1.5 \quad (I)$$

where, C, Ti, Mo, and V designate % by mass for each of them.

(7) The method for manufacturing high tensile steel sheet according to (6), having excellent formability giving 980 MPa or hither tensile strength, further containing the step of hot-dip galvanizing (including galvannealing) onto the surface of the steel sheet after the hot-rolling.

The term "consisting essentially of a ferrite single phase structure" referred to herein means allowing trace quantity of other phase or precipitate other than the precipitate according to the present invention, and preferably means that the microstructure is occupied by ferrite in area percentages of 95% or more.

In the steel sheet having 980 MPa or higher tensile strength according to the present invention, the above carbide containing Ti, Mo, and V of smaller than 10 nm of average particle size is presumably precipitated in dispersed state in a quantity of about $5\times10^5$ particle or more per 1 $\mu m^3$, and, when further high strength is needed, the carbide is presumably precipitated in dispersed state in a quantity of about $1\times10^6$ particle or more per 1 $\mu m^3$.

BEST MODE FOR CARRYING OUT THE INVENTION

Figure 1:
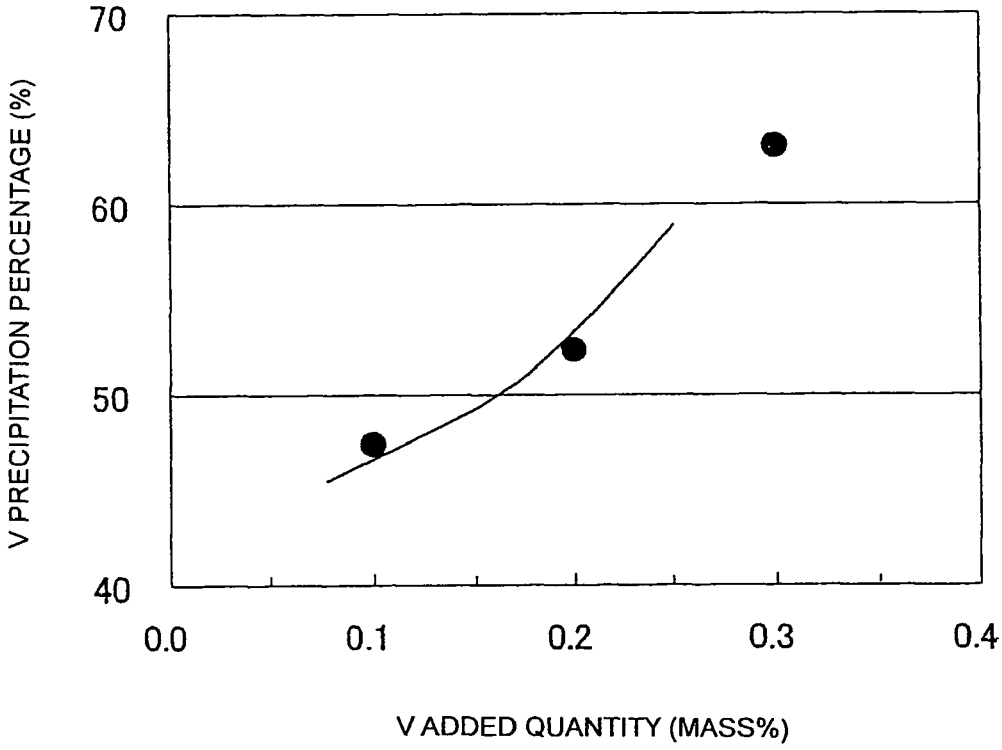
FIG. 1 is a graph showing the relation between the quantity of V addition (horizontal axis, mass %) and the V precipitation ratio signifying the precipitation efficiency (vertical axis, %)

The present invention is described in detail in terms of metal microstructure, chemical composition, manufacturing method, and the like.

<Metal Microstructure>

The high tensile steel sheet according to the present invention has a microstructure consisting essentially of a ferrite single phase, and a carbide containing Ti, Mo, and V is precipitated.

Microstructure Consisting Essentially of a Ferrite Single Phase

The matrix is prepared by a microstructure consisting essentially of a single phase of ferrite because the ferrite having small dislocation density is effective to improve the elongation, and because the single phase structure is effective to improve the stretch-flange formability, and in particular the effects becomes significant in the ductile ferrite single phase. The matrix, however, is not necessarily a complete ferrite single phase, and may be consisted essentially of ferrite single phase. That is, other phase or precipitate in a trace quantity is acceptable, and preferably the microstructure is occupied by ferrite in area percentages of 95% or more.

The ferrite having high dislocation density, such as bainitic ferrite and acicular ferrite, is not included in the ferrite phase according to the present invention, and that type of ferrite is treated as other phase.

Carbide Containing Ti, Mo, and V

Carbide containing Ti, Mo, and V is effective for strengthening steel because the carbide becomes fine particles and secures necessary quantity of precipitate.

Conventional main stream is to use TiC containing no Mo and V as the precipitate for strengthening the steel. Since, however, Ti has a strong tendency of forming precipitate, it likely becomes coarse particles and decreases the effect of strengthening the steel. Accordingly, to attain a necessary strength, the required quantity of precipitate reaches a level to deteriorate the formability.

On the other hand, as disclosed in JP-A-2003-89848, the sole addition of Mo to Ti refines the precipitate, and attains strengthening effect to some degree. However, to attain tensile strength of 980 MPa or more only by a carbide containing Ti and Mo, when a required quantity level of Ti is to be added, the required temperature may exceed the ordinary heating temperature before the hot-rolling, as described before. To perform high temperature operation, a special apparatus is, for example, needed, which increases the cost.

On the other hand, when only V is added to Ti, sufficient refinement of precipitate cannot be attained.

To the contrary, it was found that a composite carbide containing Ti, Mo, and V finely precipitates and easily secures the quantity (the number of particles) of precipitate, thus allowing strengthening the steel without deteriorating formability.

The phenomenon presumably comes from the following mechanism.

Molybdenum and vanadium, specifically Mo has lower tendency of precipitation-forming (tendency of carbide-forming) than that of Ti. Accordingly, the composite carbide does not become coarse precipitate which does not contribute to strengthening, and is allowed to stably exist in fine particles. As a result, with a relatively small adding quantity not deteriorating the formability can effectively strengthen the steel (For the case of sole V addition, however, the carbide becomes coarse unless low temperature coiling is applied). On the other hand, the combination of V and C provides very low dissolving temperature, and, when relatively large quantity of them is added to attain high strength of 980 Mpa or more, they readily dissolves at ordinary heating temperatures. In the case of sole V addition, however, the precipitation rate of V becomes low. Consequently, to form the precipitate of a size and quantity to attain high tensile force of 980 MP or more, it is presumed that the addition of both Mo and V, adding to Ti, is effective.

According to an understanding in the related art, when a large quantity of V is added to a steel containing Ti, Mo, and the like, the elongation tends to decrease, thus the addition of V is suppressed to a relatively low level. However, a detail study given by the inventors of the present invention on the Ti, Mo, and V system revealed that the increased quantity of V increases the V precipitation ratio (or the added V sufficiently precipitates as carbide), thus allowing the carbide to stably and finely precipitate, and that the high strength is attained while assuring sufficient elongation.

The composition of carbide affects the existence of stable and fine carbide. In concrete terms, when the average composition of carbide satisfies the relation of [V/(Ti+Mo+V)≧0.3], where Ti, Mo, and V are expressed by atomic %, the effect to suppress the formation of coarse precipitate increases, thereby attaining desired fine precipitate. Consequently, the present invention requires that the carbide containing Ti, Mo, and V within a range of [V/(Ti+Mo+V)≧0.3], where Ti, Mo, and V are expressed by atomic %, precipitates dispersed in ferrite grains. The upper limit of V/(Ti+Mo+V) is preferably limited to about 0.7.

According to the finding of the inventors of the present invention, the optimum carbide composition for the refinement of particles is approximately 1:1:2 as the atomic ratio of Ti:Mo:V. In an average composition of carbide, therefore, when the atomic ratio of Ti:Mo:V is expressed as a:b:c, it is further preferable to satisfy a=0.6 to 1.4, b=0.6 to 1.4, and c=1.4 to 2.8, while a+b+c=4.

By bringing the average particle size of the composite carbide to smaller than 10 nm, the strain in the vicinity of the precipitate becomes further effective as the resistance against dislocation movement, and the composite carbide efficiently strengthens the steel. Consequently, the present invention specifies that the carbide containing Ti, Mo, and V, having smaller than 10 nm of average particle size is precipitated, and preferably the average particle size is 5 nm or smaller.

In some cases, carbide containing Ti, Mo, and V precipitates on a coarse precipitate which hardly affects the strength. Since it is not suitable to treat that type of precipitate as the target for evaluating particle size, the average particle size is determined eliminating the precipitate exceeding 100 nm of particle size.

In the steel sheet having 980 MPa of tensile strength (TS) according to the present invention, the composite carbide having smaller than 10 nm of average particle size is naturally observed in larger quantity than in conventional TS 780 MPa class steel sheets. The composite carbide in the steel sheet according to the present invention presumably gives dispersed precipitate in a quantity of about $5\times10^5$ particles or more per 1 $\mu m^3$, based on an approximation on the data of JP-A-2002-322539. Since JP-A-2002-322539 does not disclose the data in a zone exceeding TS 800 MPa, an extrapolation was given to TS 980 MPa (of logarithmic expression) with a simple assumption of straight line correlation between the logarithmic expression of TS and the logarithmic expression of fine carbide density.

<Chemical Composition>

According to the present invention, the desired elongation, the desired stretch-flange formability, and 980 MPa or higher strength can be obtained if only the above metal microstructure is satisfied, and the chemical composition is not specifically limited. However, it is preferable that the steel contains more than 0.06 and not more than 0.24% C, 0.3% or less Si, 0.5 to 2.0% Mn, 0.06% or less P, 0.005% or less S, 0.06% or less Al, 0.006% or less N, 0.05 to 0.5% Mo, 0.03 to 0.2% Ti, more than 0.15 and not more than 1.2% V, by mass, and balance of Fe and inevitable impurities, and the content of C, Ti, Mo, and V satisfies the formula (I), $$0.8 \leqq (C/12)/\{(Ti/48)+(Mo/96)+(V/51)\} \leqq 1.5 \quad (I)$$

where, C, Ti, Mo, and V designate % by mass for each of them.

The conditions for the respective components (% by mass unless otherwise noted) are described below.

C: more than 0.06% and not more than 0.24%

Carbon is effective for forming carbide and strengthening steel. If, however, the C content is not more than 0.06%, the strengthening of steel becomes insufficient, and if the C content exceeds 0.24%, it becomes difficult to spot-weld the steel sheets. Accordingly, the C content is preferably specified to a range from more than 0.06% and not more than 0.24%, and more preferably 0.07% or more. Furthermore, to attain 1100 MPa or higher tensile strength, the C content is preferably specified to 0.1% or more. The most preferable lower limit of C content is 0.11%, and the upper limit thereof is preferably about 0.2%.

Si: 0.3% or less

Silicon is conventionally used positively as an element effective in solid-solution strengthening, and the high tensile steels often contain Si in quantities of about 0.4% or more. The present invention, however, specifies the Si content to 0.3% or less because the addition of Si by more than 0.3% enhances the C precipitation from ferrite to likely precipitate coarse iron carbide at grain boundaries, which deteriorates the stretch-flange formability.

According to the present invention, by reducing the Si content, the load in rolling austenite decreases to make manufacturing thin gauge sheets easy. That is, if the Si content exceeds 0.3%, the rolling for materials having 2.5 mm or smaller thickness becomes unstable, and the formed sheet shape becomes worse.

With those reasons, the Si content is preferably specified to 0.3% or less, more preferably 0.15% or less, and desirably 0.05% or less.

Although Si may not be positively added, extreme reduction of Si content increases the manufacturing cost so that a practical lower limit of the Si content is about 0.001%.

Mn: 0.5 to 2.0%

Manganese is preferably added in a quantity of 0.5% or more from the viewpoint to assist the strengthening of steel through the solid-solution strengthening. If, however, the Mn content exceeds 2.0%, Mn segregates, and also a hard phase is formed, thereby deteriorating the stretch-flange formability. Consequently, the Mn content is preferably specified to a range from 0.5 to 2.0%, and more preferably 1.0% or more.

P: 0.06% or less

Phosphorus is effective to assist the solid-solution strengthening. If, however, the P content exceeds 0.06%, P segregates to deteriorate the stretch-flange formability. Therefore, the P content is preferably specified to 0.06% or less. Although P may not be positively added, extreme reduction of P content increases the manufacturing cost so that a practical lower limit of the P content is about 0.001%.

S:0.005% or less

Sulfur content is preferably as small as possible. If the S content exceeds 0.005%, the stretch-flange formability deteriorates. Accordingly, the S content is preferably specified to 0.005% or less. From the point of manufacturing cost, a practical lower limit is about 0.0005%.

Al: 0.06% or less

Aluminum may be added as a deoxidizer. If, however, the Al content exceeds 0.06%, the elongation and the stretch-flange formability deteriorate. Consequently, the Al content is preferably specified to 0.06% or less. Although the lower limit of Al content is not specifically limited, the Al content is preferably specified to 0.01% or more when sufficiently attaining the effect of deoxidizer.

N: 0.006% or less

The quantity of N is preferably as small as possible. If the N content exceeds 0.006%, the quantity of coarse nitride increases to deteriorate the stretch-flange formability. Therefore, the N content is preferably specified to 0.006% or less. From the point of manufacturing cost, a practical lower limit is about 0.0005%.

Mo: 0.05 to 0.5%

Molybdenum is an important element in the present invention. By adding Mo in quantities of 0.05% or more, Mo affects to suppress pearlite transformation. Furthermore, Mo forms a fine precipitate with Ti and V, (composite carbide), thus allowing steel to strengthen while assuring excellent elongation and stretch-flange formability. If, however, the Mo content exceeds 0.5%, a hard phase is formed to deteriorate the stretch-flange formability. Therefore, the Mo content is preferably specified to a range from 0.05 to 0.5%. A more preferable lower limit thereof is 0.15%, and a more preferable upper limit thereof is 0.4%.

Ti: 0.03 to 0.2%

Titanium is an important element in the present invention. By forming a composite carbide with Mo and V, the steel is strengthened while assuring excellent elongation and stretch-flange formability. If, however, the Ti content is less than 0.03%, the effect of strengthening steel becomes insufficient. If the Ti content exceeds 0.2%, the stretch-flange formability deteriorates, and the carbide cannot be dissolved unless the slab-heating temperature before hot-rolling is brought to as high as 1300° C. or above. Therefore, addition of Ti above 0.2% cannot effectively generate fine precipitate. Consequently, the Ti content is preferably specified to a range from 0.03 to 0.2%. A more preferable lower limit of the Ti content is 0.08%.

V: more than 0.15% and not more than 1.2%

Vanadium is an important element in the present invention. As described above, the composition of carbide has an influence to allow the carbide to exist in fine particles. In concrete terms, if the average composition of carbide satisfies [V/(Ti+Mo+V)≧0.3], (Ti, Mo, and V are atomic %), or preferably if the average composition of carbide satisfies Ti:Mo:V as 0.6 to 1.4:0.6 to 1.4:1.4 to 2.8, by atomic ratio, (while a+b+c=4), the effect of suppressing the coarsening of precipitate increases, thus allowing to obtain the desired fine precipitate. To this point, a detail study of the inventors of the present invention revealed that the V precipitation efficiency increases by adding a large quantity of C, exceeding 0.06%, and by adding a large quantity of V, thus obtaining a precipitate satisfying the condition of [V/(Ti+Mo+V)≧0.3].

FIG. 1 is a graph showing the relation between the quantity of V addition (horizontal axis, mass %) and the V precipitation ratio (vertical axis, %). The V precipitation ratio signifies the fraction of V actually formed the precipitate against the quantity of added V, expressing the precipitation efficiency of V. The result was obtained using hot-rolled steel sheets prepared from base materials of steels containing 0.11 to 0.15% C, 0.01% Si, 1.35% Mn, 0.003% N, 0.32% Mo, 0.16% Ti, while varying V in a range from 0.1 to 0.3%, applying hot-rolling at 920° C. of finishing temperature and 620° C. of coiling temperature. The C content and the V content were varied so as the ratio of the number of atoms of C to (Ti+Mo+V) to become nearly constant (about 1.0 to about 1.1), or varying (C quantity, V quantity)=(0.11%, 0.1%), (0.13%, 0.2%), and (0.15%, 0.3%). The quantity of precipitated V in the hot-rolled steel sheets was determined by the quantitative analysis of extraction residue, and derived by:

$$V\text{ precipitation ratio}(\%)=(\text{Quantity of precipitated } V\ (\text{mass }\%)/(\text{Quantity of added } V(\text{mass }\%))\times 100$$

As seen in FIG. 1, increase in the added quantity of V increases the V precipitation ratio, giving very good precipitation efficiency: [V precipitation ratio>50%] at V>0.15%. These steel sheet microstructures were confirmed as a ferrite single phase structure.

Figure 2:
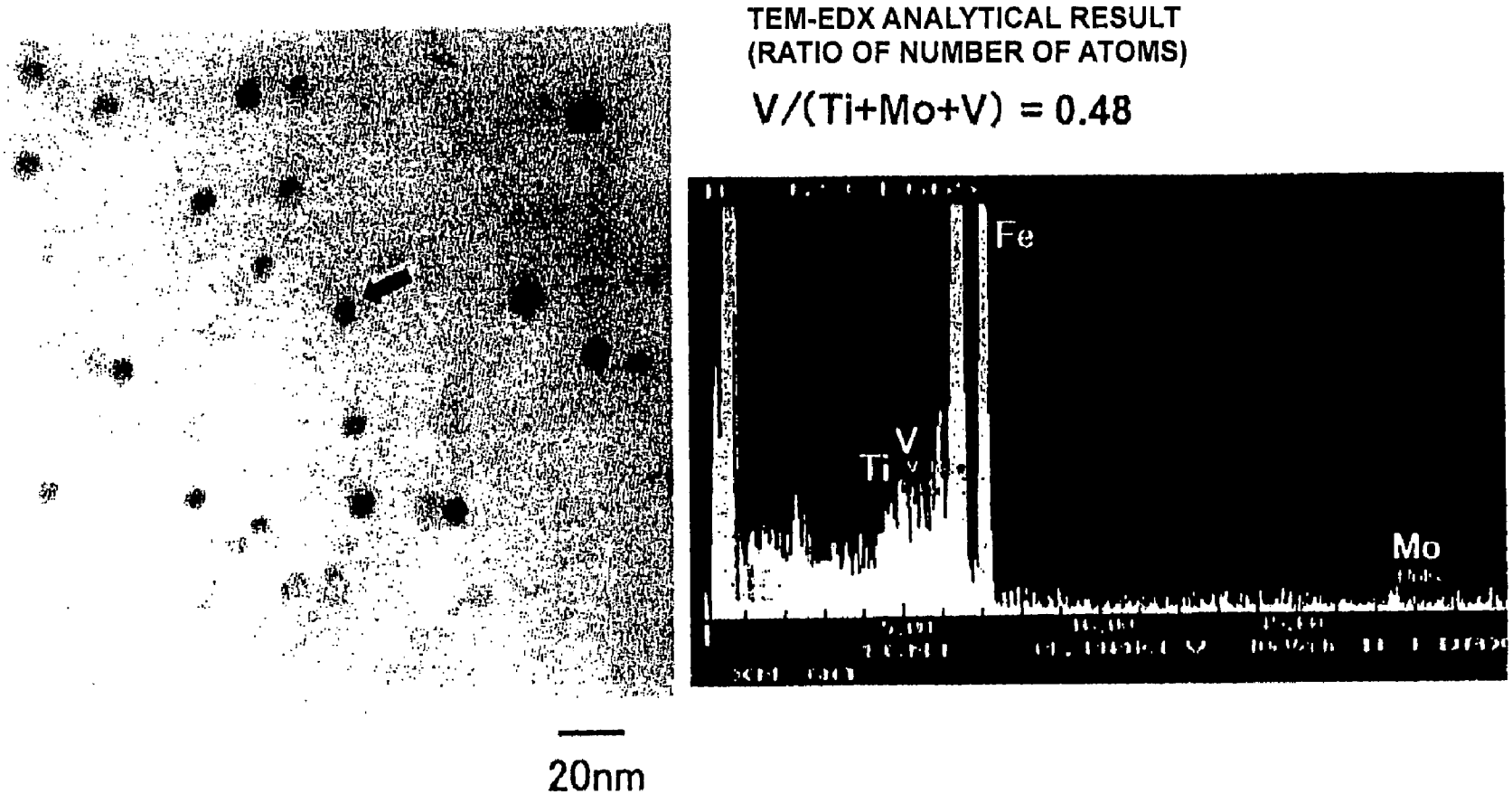
FIG. 2 shows an example of fine carbide containing Ti, Mo, and V, obtained in the present invention, (observed result of a transmission electron microscope and analytical result of EDX).

FIG. 2 shows an example of precipitate giving good precipitation efficiency. The left-hand side photograph in FIG. 2 is a transmission electron microscope (TEM) photograph of precipitate. The right-hand side photograph of FIG. 2 is a graph of observed result of Ti, Mo, and V in the precipitate determined by an energy-dispersive X-ray spectrometer (EDX). These precipitates are structured mainly of carbide, which was confirmed based on the positions of X-ray diffraction peaks, and on other characteristics. The result was obtained using hot-rolled steel sheets prepared from base materials of steels containing 0.15% C, 0.01% Si, 1.35% Mn, 0.003% N, 0.32% Mo, 0.16% Ti, and 0.3% V, applying hot-rolling at 920° C. of finishing temperature and 620° C. of coiling temperature. Other major components were: 0.01% P, 0.001% S, and 0.05% Al.

The observation of precipitate was given by TEM on a thin film prepared from the manufactured hot-rolled steel sheet after pickled. The composition of precipitate in terms of Ti, Mo, and V was determined by the analysis of EDX in TEX. According to the analytical result in FIG. 2, Ti:Mo:V is 1.2:0.9:1.9 by atomic ratio, therefore, the value of V/(Ti+Mo+V) is 0.48.

Based on the experimental results, the inventors of the present invention further conducted investigations, and found the following. By adding V to the steel in quantities of more than 0.15% to attain very good precipitation percentages, the average composition of the carbide satisfies, as described before, (Ti+Mo+V)≧0.3, where Ti, Mo, and V are expressed by atomic %, thus a fine composite carbide is formed together with Ti and Mo, and strengthens steel while assuring excellent elongation and stretch-flange formability. More preferably, by adding V to the steel in quantities of 0.2% or more, the average composition of the carbide stably satisfies the condition of Ti:Mo:V (atomic ratio) as 0.6 to 1.4:0.6 to 1.4:1.4 to 2.8, (while a+b+c=4), which provides more efficiently high tensile state. A more preferable lower limit of V content is 0.3%.

If, however, the V content exceeds 1.2%, the centerline segregation strongly appears, and induces deterioration of elongation and toughness. Accordingly, the V content is preferably specified to 1.2% or less, and more preferably 0.8% or less.

Therefore, the V content is preferably specified to a range from more than 0.15% and not more than 1.2%, and more preferably from 0.2 to 0.8%. Even when the V content is 1.2%, the carbide completely dissolves if the slab heating temperature is at an ordinary temperature of around 1200° C.

Although the preferable adding range of Ti, Mo, and V is given above, it is more preferable that the adding ratio is corresponding to the Ti:Mo:V ratio of the target carbide, (0.6 to 1.4:0.6 to 1.4:1.4 to 2.8, (while a+b+c=4)). To convert % by weight into atomic ratio, each of Ti, Mo, and V is divided by the respective atomic weights (48, 96, and 51), and the percentage is derived. Nevertheless, even when the steel composition does not satisfy the above ratio, the atomic ratio in the fine carbide does not necessarily immediately come outside the suitable range.

$$0.8 \leqq (C/12)/\{(Ti/48)+(Mo/96)+(V/51)\} \leqq 1.5$$

(where, C, Ti, Mo, and V are the mass % for each of them.)

In the present invention, the balance of adding quantity of C, Ti, Mo, and V is very important.

Theoretically, when the ratio of the number of atoms of C to (Ti, Mo, V) in steel is 1, or when (C/12)/{(Ti/48)+(Mo/96)+(V/51)}=1, the carbon is expected to precipitate as a composite carbide in just the amount corresponding C amount. According to a survey of the inventors of the present invention, however, if the above specified range of content of C, Ti, Mo, and V is established, and if the value of (C/12)/{(Ti/48)+(Mo/96)+(V/51)} is in a range from 0.8 to 1.5, a large quantity of carbide having a composition satisfying the condition of Ti, Mo, and V as V/(Ti+Mo+V)≧0.3 is allowed to easily disperse finely in the ferrite, or disperse at average particle sizes of smaller than 10 nm. More preferable range of above ratio of the number of atoms is from 0.8 to 1.3.

If the (C/12)/{(Ti/48)+(Mo/96)+(V/51)} is smaller than 0.8, the precipitate becomes coarse, and 980 MPa or higher strength cannot be stably attained. If the (C/12)/{(Ti/48)+(Mo/96)+(V/51)} exceeds 1.5, the C quantity becomes excessive to form pearlite, which deteriorates the formability. With excess C content, similarly, the carbide likely becomes coarse.

Others

High tensile steel sheets may further contain other carbide-forming elements, specifically Nb, W, and the like in some cases. Since in the present invention, however, their addition is preferably avoided and their quantities are limited to a range allowed as impurities because they may inversely affect the optimum balance of Ti, Mo, and V. In particular, Nb increases the load in hot-rolling to make the manufacturing of thin gauge sheets difficult, and, under the steel composition of the present invention, Nb may enhance coarsening of C to decrease the strength. Therefore, the Nb content is preferably limited to 0.02% or less, and more preferably 0.003% or less. Also the W content is preferably limited to 0.02% or less, and more preferably 0.005% or less.

Balance of the above chemical composition of the steel sheet according to the present invention is iron and inevitable impurities. Examples of the impurities are, other than above, Cr, Cu, Sn, Ni, Ca, Zn, Co, B, As, Sb, Pb, and Se. Although the acceptable Cr content is 1% or less, a preferable Cr content is 0.6% or less, and most preferably 0.1% or less. Allowable content of other respective elements is 0.1% or less, and preferably 0.03% or less.

<Manufacturing Method>

According to the present invention, the steel having above composition is prepared by melting to cast to form a slab (including ingot, slab (in narrow meaning), and thin slab), followed by hot-rolling under the condition of 880° C. or higher finishing temperature and 570° C. or higher coiling temperature.

The thickness of the steel sheet according to the present invention, or the sheet thickness after hot-rolling, is preferably in an approximate range from 1.4 to 5.0 mm. However, for the manufacture of thin gauge sheets having 2.5 mm or smaller thickness, which have been difficult in the related art, the steel sheet according to the present invention is applicable without raising problems.

On manufacturing a thin gauge hot-rolled steel sheet having 2.5 mm or smaller thickness, giving 980 MPa or higher tensile strength, the present invention forms the precipitate contributing to the strength after rolling. As a result, the steel is not hardened during hot-rolling, and the manufacture is conducted without specifically increasing the load on hot-rolling passes.

Slab Heating Condition

The slab may be treated by hot-rolling after cooled and after reheated to a specified temperature (what is called as "slab reheating temperature"), or may be immediately hot-rolled before the slab is cooled to under the specified temperature. Furthermore, the slab may be heated for a short period to the specified temperature before the slab is entirely cooled, followed by hot-rolling.

The slab reheating temperature is preferably in an approximate range from 1150° C. to 1280° C. to dissolve the carbide into solid solution again, (or not to precipitate carbides). For the case of the steel composition of the present invention, the re-dissolving into solid solution can be attained at a lower slab reheating temperature than that for conventional steels having similar composition, (Ti-carbide based, or Ti—Mo-carbide based).

Finishing Temperature: 880° C. or Above

The finishing temperature is important to secure the elongation and the stretch-flange formability, and to reduce the rolling load.

If the finishing temperature is below 880° C., the surface layer gives coarse grains to deteriorate the elongation and the stretch-flange formability. In addition, there is an increase in accumulated strain which is generated from the progress of rolling in non-recrystallization state, and significantly increases the rolling load, thus the hot-rolling of thin gauge sheets becomes difficult. Consequently, the finishing temperature is specified to 880° C. or above.

With the steel composition according to the present invention, the strength can be assured at finishing temperatures lower than that for conventional steels having similar composition, (Ti-carbide based, or Ti—Mo-carbide based) With the advantage, the manufacture of thin gauge sheets is available, which are difficult to be manufactured from conventional steels.

The upper limit of the finishing temperature is not necessarily limited. However, high temperature finishing generates coarse crystal grains, which decreases the strength of the crystal structure, and induces requirement of additional strengthening of the steel by the fine carbide and the like, thus increasing unnecessary works. Consequently, the temperature at the end of the rolling is preferably specified to 1000° C. or below.

Coiling Temperature: 570° C. or Above

To obtain a ferrite structure, to secure a sufficient quantity of carbide precipitation, and to suppress the quantity of water-injection on the runout table to let the thin gauge sheet stably travel, the coiling temperature is specified to 570° C. or above. To prevent meanders of the hot strip on the runout table, the coiling temperature is preferably specified to 600° C. or above. To suppress the pearlite generation, a preferable coiling temperature is 700° C. or below.

For the steel having the specified composition, by satisfying the above hot-rolling conditions, the average composition of the precipitated carbide satisfies $V/(Ti+Mo+V) \geqq 0.3$ and the ratio of Ti:Mo:V=0.6 to 1.4:0.6 to 1.4:1.4 to 2.8 (where sum of them is 4) in the carbide, and achieves the average particle size of smaller than 10 nm.

Others

The high tensile steel sheet according to the present invention includes the one subjected to surface treatment and the one subjected to surface coating treatment. In particular, the steel sheet according to the present invention is suitably applied to the one forming a hot-dip galvanized film thereon to make the hot-dip galvanized steel sheet. That is, since the steel sheet according to the present invention has good formability, the steel sheet maintains good formability even when a hot-dip galvanized film is formed thereon.

The term "hot-dip galvanizing" signifies the hot-dipplating consisting of zinc or consisting mainly of zinc, (or containing about 80% by mass or more of zinc), and includes the one that contains alloying elements such as Al and Cr, other than zinc. Furthermore, either of as hot-dip plated or applying alloying treatment after plating (i.e. galvannealed) will do.

EXAMPLES

Example 1

Slabs having the respective chemical compositions given in Table 1 were heated to 1250° C., and an ordinary hot-rolling process was applied to the slabs to finish the respective sheets to 3.5 mm of thickness at 880° C. to 930° C. of finishing temperatures. Then, the sheets were coiled at coiling temperatures above 600° C. while varying the cooling rate and the coiling temperature to obtain steel sheets having various microstructures. In Table 1, the value A designates the value of $(C/12)/\{(Ti/48)+(Mo/96)+(V/51)\}$ in the above formula (I).

The obtained steel sheets were pickled, and thin films were prepared from the depths of ⅛, ¼, ⅜, and ½ of the thickness, respectively, of the steel sheet. Each of thus prepared thin films was observed by transmission electron microscope (TEM) to determine the microstructure and to determine the size of precipitate.

The composition of the precipitate in terms of Ti, Mo, and V was determined by the analysis of energy-dispersive X-ray spectrometer (EDX) in the TEM, thus derived the V fraction (at atomic ratio)=V/(Ti+Mo+V) in the precipitate, (Ti, Mo, and V are atomic %), and the atomic ratio of Ti:Mo:V.

Regarding the precipitate, 30 particles of them, having 100 nm or smaller particle size, were randomly selected, and each of them was analyzed to determine the particle size and the content of Ti, Mo, and V. The particle size was determined by the image processing using circle-approximation, and the arithmetic mean of the above 30 precipitates was adopted as the average particle size. The V fraction and the value of Ti:Mo:V were determined from the average composition derived from the arithmetic mean of the contents of Ti, Mo, and V for above 30 precipitates. Thus derived average particle size and average composition for the precipitates having 100 nm or smaller particle size was adopted as the average particle size and the average composition of the carbide containing Ti, Mo, and V.

From the prepared steel sheet, a JIS No. 5 tensile test piece and a hole expanding test piece were sampled. The tensile test piece was sampled in the direction normal to the rolling direction.

The hole expanding test was conducted by preparing a test piece having a punch hole at the center of the 130 mm square steel sheet applying a punch of 10 mm in diameter with a clearance (on one side) of 12.5% to the sheet thickness. By pressing-up a 60° conical punch from the opposite side to the burr-side of punching hole, the hole diameter d (mm) at the point of crack-penetration across the steel sheet was determined, then the hole expanding rate λ was calculated by the following formula.

$$\lambda(\%)=\{(d-10)/10\}\times 100$$

Table 2 shows the microstructure, the average particle size of the precipitate, the composition of the precipitate (V fraction), the tensile strength (TS), the elongation (El), and the hole expanding rate (λ).

As seen in Table 2, all Steel Nos. 1 to 5 of the present invention were confirmed as: consisting of ferrite structure, giving smaller than 10 nm of average particle size of the precipitate, showing 0.3 or larger V fraction (atomic ratio) of the precipitate, and having excellent elongation and stretch-flange formability with 980 MPa or larger tensile strength (TS).

To the contrary, Steel No. 6 as Comparative Example contained less C and V quantities so that the quantity of precipitate necessary for strengthening the steel was small, thus the tensile strength (TS) became less than 980 MPa. Steel No. 7 contained excess C quantity and small Mo quantity so that pearlite was formed, and also the precipitate therein became coarse, thereby deteriorating both the elongation and the stretch-flange formability. Steel No. 8 contained large quantity of V, the precipitate therein became coarse, and also martensite was formed, thereby resulting in decreased value of both the elongation and the stretch-flange formability. Steel No. 9 was small in Ti and V quantities so that the quantity of precipitate necessary to strengthen the steel became insufficient, thereby giving less than 980 MPa of tensile strength (TS).

TABLE 1

| Steel | Chemical composition (mass %) | | | | | | | | | | |
|---|---|---|---|---|---|---|---|---|---|---|---|
| No. | C | Si | Mn | P | S | Al | N | Mo | Ti | V | A value* |
| 1 | 0.151 | 0.01 | 1.35 | 0.011 | 0.0008 | 0.046 | 0.0031 | 0.32 | 0.16 | 0.31 | 0.99 |
| 2 | 0.149 | 0.01 | 1.34 | 0.010 | 0.0007 | 0.043 | 0.0030 | 0.27 | 0.14 | 0.32 | 1.03 |
| 3 | 0.167 | 0.02 | 1.33 | 0.012 | 0.0008 | 0.044 | 0.0032 | 0.31 | 0.15 | 0.44 | 0.93 |
| 4 | 0.211 | 0.02 | 1.35 | 0.010 | 0.0008 | 0.044 | 0.0033 | 0.30 | 0.15 | 0.77 | 0.82 |
| 5 | 0.111 | 0.01 | 1.35 | 0.010 | 0.0009 | 0.043 | 0.0029 | 0.16 | 0.08 | 0.23 | 1.18 |
| 6 | 0.051 | 0.01 | 1.36 | 0.011 | 0.0007 | 0.042 | 0.0031 | 0.07 | 0.03 | 0.14 | 1.04 |
| 7 | 0.251 | 0.01 | 1.33 | 0.011 | 0.0006 | 0.041 | 0.0032 | 0.02 | 0.12 | 0.37 | 2.10 |
| 8 | 0.185 | 0.02 | 1.34 | 0.010 | 0.0007 | 0.041 | 0.0033 | 0.31 | 0.16 | 1.31 | 0.48 |
| 9 | 0.152 | 0.02 | 1.34 | 0.011 | 0.0009 | 0.043 | 0.0029 | 0.29 | 0.02 | 0.09 | 2.43 |

*A value: (C/12)/{(Ti/48) + (Mo/96) + (V/51)}

TABLE 2

| Steel No. | Microstructure* | Fine carbide | | | TS (MPa) | EI (%) | λ (%) | Remark |
|---|---|---|---|---|---|---|---|---|
| | | Average particle size (nm) | V fraction** (atomic ratio) | Ti:Mo:V (atomic ratio) | | | | |
| 1 | F | 4 | 0.48 | 1.0:1.1:1.9 | 1178 | 17.9 | 38 | Example of the invention |
| 2 | F | 4 | 0.44 | 1.1:1.1:1.8 | 1176 | 17.8 | 39 | Example of the invention |
| 3 | F | 3 | 0.41 | 1.2:1.2:1.6 | 1192 | 17.1 | 37 | Example of the invention |
| 4 | F | 3 | 0.47 | 1.1:1.0:1.9 | 1197 | 16.8 | 38 | Example of the invention |
| 5 | F | 4 | 0.45 | 1.2:1.0:1.8 | 992 | 19.2 | 41 | Example of the invention |
| 6 | F | 3 | 0.23 | 2.1:1.0:0.9 | 791 | 23.4 | 87 | Comparative Example |
| 7 | F + P | 17 | 0.46 | 1.5:0.7:1.8 | 1181 | 9.8 | 27 | Comparative Example |
| 8 | F + M | 14 | 0.46 | 1.7:0.5:1.8 | 1171 | 8.2 | 28 | Comparative Example |
| 9 | F | 5 | 0.18 | 1.5:1.8:0.7 | 521 | 39.1 | 134 | Comparative Example |

*Microstructure: F means ferrite, P means pearlite, and M means martensite.
**V fraction = V/(Ti + Mo + V)

Example 2

A steel having the chemical composition of 0.150% C, 0.02% Si, 1.34% Mn, 0.010% P, 0.0008% S, 0.043% Al, 0.0032% N, 0.32% Mo, 0.15% Ti, and 0.30% V, by mass, (A value: (C/12)/{(Ti/48)+(Mo/96)+(V/51)}=1.01), was melted to form slabs. The slabs were heated to austenite region, and then were hot-rolled to finish the rolling at the respective temperatures given in Table 3. After the rolling, the hot-rolled steel sheets were cooled to the respective coiling temperatures given in Table 3, and was coiled at the respective coiling temperatures. Table 3 also gives the sheet thickness.

Samples were obtained from the central part in the width direction on thus prepared coil. The JIS No. 5 tensile test pieces were prepared so as the tensile direction to become normal to the rolling direction. Thus the tensile test was conducted. From the samples obtained at the same position as above, the precipitate investigation was conducted by similar procedure to that in Example 1, and also the steel microstructure was observed. Furthermore, the sheet shape after rolling was visually evaluated. The results are also given in Table 3. The evaluation criterion of the sheet shape after rolling is: ○ for visually flat, and X for significant waving.

Table 3, as the result, shows examples of 1180 MPa class steel sheets having the same chemical composition with each other, while varying the sheet thickness, the finishing temperature, and the coiling temperature. Steel Nos. 10 to 14, which secure 880° C. or higher finishing temperature and 570° C. or higher coiling temperature formed the precipitate having smaller than 10 nm of average particle size independent of the sheet thickness, and attained the target tensile strength (TS) and the elongation. Also the sheet shape of them was ingood state. These steel sheets were confirmed to have a ferrite single phase structure by the microstructural observation. To the contrary, Steel No. 15 of Comparative Example was low in the finishing temperature so that the crystal grains became coarse at the surface layer part, and the precipitate also became coarse, thus the steel failed to satisfy the target strength and gave low elongation. In addition, the sheet shape showed significant waving. Since steel No. 16 was low in the coiling temperature, the quantity of precipitate necessary for strengthening the steel became insufficient, which resulted in failing to attain the target tensile strength (TS), and waving also became significant.

Steel Nos. 10 to 14 were estimated to have the quantity of precipitate of about $1\times10^6$ particles per 1 $\mu M^3$, and Steel No. 15 and Steel No. 16 were estimated to have the quantity of precipitate of about $2.5\times10^5$ to $4\times10^5$ particles.

TABLE 3

| Steel No. | Sheet thickness (mm) | Finishing temp. (° C.) | Coiling temp. (° C.) | Fine carbide: Average particle size (nm) | Fine carbide: V fraction* (atomic ratio) | Fine carbide: Ti:Mo:V (atomic ratio) | TS (MPa) | EI (%) | Shape evaluation | Remark |
|---|---|---|---|---|---|---|---|---|---|---|
| 10 | 1.2 | 940 | 620 | 3 | 0.46 | 1.2:1.0:1.8 | 1181 | 17.9 | ○ | Example of the invention |
| 11 | 1.4 | 940 | 610 | 4 | 0.45 | 1.0:1.2:1.8 | 1185 | 17.8 | ○ | Example of the invention |
| 12 | 1.6 | 930 | 610 | 4 | 0.43 | 1.2:1.1:1.7 | 1182 | 17.1 | ○ | Example of the invention |
| 13 | 2.0 | 920 | 620 | 3 | 0.48 | 1.1:1.0:1.9 | 1183 | 17.1 | ○ | Example of the invention |
| 14 | 2.3 | 920 | 620 | 4 | 0.45 | 1.2:1.0:1.8 | 1182 | 17.7 | ○ | Example of the invention |
| 15 | 2.0 | 850 | 610 | 18 | 0.16 | 2.1:1.3:0.6 | 842 | 19.7 | X | Comparative Example |
| 16 | 2.0 | 920 | 540 | 5 | 0.11 | 2.1:1.5:0.4 | 935 | 18.1 | X | Comparative Example |

*V fraction = V/(Ti + Mo + V)

Example 3

Steels having the respective chemical compositions shown in Table 4 were hot-rolled at 920° C. or higher finishing temperatures and 620° C. of coiling temperature to manufacture the respective hot-rolled steel sheets having 1.6 mm in thickness. Each of these hot-rolled steel sheets was pickled and was galvannealed, (or applied hot-dip galvanizing in a plating bath of zinc, followed by alloying treatment (for the zinc-plated layer)).

Similar to Example 1, the thin film prepared from thus obtained steel sheet was observed by transmission electron microscope (TEM) to determine the microstructure, and the size of the precipitate was determined, and furthermore, the precipitate composition in terms of Ti, Mo, and V was determined by the analysis by an energy-dispersive X-ray spectrometer (EDX) in TEM. In addition, from the prepared steel sheet, a JIS No. 5 tensile test piece and a hole expanding test piece were sampled to conduct the tensile test and the hole expanding test. Table 5 shows the structure, the average particle size of the precipitate, the composition of the precipitate (V fraction), the tensile strength (TS), the elongation (El), and the hole expanding rate (λ). The A value in Table 4 is, similar to Table 1, the value of (C/12)/{(Ti/48)+(Mo/96)+(V/51)} in the formula (I).

As seen in Table 5, Steel No. 17 which is Example of the present invention showed good elongation and stretch-flange formability even after hot-dip galvanizing. To the contrary, Steel No. 18 which is Comparative Example gave coarse precipitate, and the precipitate contained very little V, thus the elongation and the stretch-flange formability were low.

TABLE 4

| Steel No. | Chemical composition (mass %): C | Si | Mn | P | S | Al | N | Mo | Ti | V | A value* |
|---|---|---|---|---|---|---|---|---|---|---|---|
| 17 | 0.149 | 0.01 | 1.35 | 0.010 | 0.0008 | 0.044 | 0.0031 | 0.31 | 0.17 | 0.31 | 0.97 |
| 18 | 0.151 | 0.01 | 1.34 | 0.011 | 0.0007 | 0.045 | 0.0032 | 0.30 | 0.15 | 0.02 | 1.89 |

*A value: (C/12)/{(Ti/48) + (Mo/96) + (V/51)}

TABLE 5

| Steel No. | Microstructure* | Fine carbide: Average particle size (nm) | Fine carbide: V fraction** (atomic ratio) | Fine carbide: Ti:Mo:V (atomic ratio) | TS (MPa) | EI (%) | λ (%) | Remark |
|---|---|---|---|---|---|---|---|---|
| 17 | F | 4 | 0.45 | 1.2:1.0:1.8 | 1181 | 17.9 | 38 | Example of the invention |
| 18 | F | 5 | 0.04 | 2.9:0.9:0.2 | 1180 | 11.6 | 25 | Comparative Example |

*Microstructure: F means ferrite, P means pearlite, and M means martensite.
**V fraction = V/(Ti + Mo + V)

Example 4

Slabs having the respective chemical compositions given in Table 6 were heated to 1250° C., and an ordinary hot-rolling process was applied to the slabs to finish to the respective sheets having 2.5 mm in thickness at 880° C. to 930° C. of finishing temperatures. Then, the sheets were coiled at coiling temperature of 620° C. The components other than above were adjusted within 0.001 to 0.15% Si, 0.0005 to 0.005% S, 0.01 to 0.06% Al, and 0.0005 to 0.006% N, by mass.

The obtained steel sheets were pickled, and the fine carbide and the steel sheet characteristics (mechanical characteristics and formability) were investigated using similar procedure to that in Example 1. The result is given in Table 6.

From the results of Steel Nos. 21 to 27 (varying V), Steel Nos. 28 to 32 (varying Mo), and Steel Nos. 33 to 36 and 30 (varying Ti), which varied any one of the contents of Ti, Mo, and V within a preferable range of A value while maintaining the C content to a constant value, it is understood that extremely superior steel sheet having 980 MPa or higher strength and good elongation and stretch-flange formability can be attained by adjusting all of the Ti, Mo, and V contents within the range of the present invention. Furthermore, from the result of investigations on the fine carbide in the steels manufactured under these conditions, it is understood that, by allowing the V fraction and the ratio of Ti:Mo:V to be with in a preferable range, and thus precipitating fine and sufficient quantity of them, high tensile strength is effectively attained specifically without deteriorating the formability.

Regarding the adding quantity of V, by 0.20% or more of V content, (Steel No. 22), further significant high strength can be obtained than Examples of the present invention having less than 0.20% V, (Steel No. 23, for example), while inducing very little deterioration of elongation and stretch-flange formability.

From the result of Steel Nos. 37 to 41 which varied C quantity under the condition of almost constant ratio of Ti, Mo, and V in the steel chemical composition and of constant A value, and from the results of Steel Nos. 42 to 46 which varied A value under the condition of almost constant Ti, Mo, and V ratio in the chemical composition of steel and of constant C content, it is understood that the C quantity and the A value also should preferably satisfy the suitable conditions.

As understood from Steel Nos. 47 to 50, the P quantity and the Mn quantity can further adjust the tensile strength of steel sheet to some extent.

To the contrary, Steel Nos. 24, 36, and 37 which contained insufficient quantity of V, Ti, or C induced insufficient strength of steel sheet presumably caused by the insufficient quantity of carbide. Also for Steel No. 41 which contained excess quantity of C to allow progress of pearlite formation induced insufficient strength of steel sheet presumably caused by the insufficient quantity of carbide.

Steel Nos. 32 and 33 which contained insufficient quantity of Mo or excess quantity of Ti resulted in coarse carbide formation, and insufficient strength. For the case of A value outside the suitable range, (Steel Nos. 42 and 46), there was also induced insufficient strength of steel sheet presumably caused by the insufficient quantity of carbide.

Steel Nos. 27 and 28 which contained excess quantity of Ti or Mo resulted in significantly deteriorated elongation and stretch-flange formability.

TABLE 6

| Steel | Chemical composition (mass %) | | | | | | |
|---|---|---|---|---|---|---|---|
| No. | C | Mn | P | Mo | Ti | V | A value* |
| 21 | 0.13 | 1.34 | 0.01 | 0.30 | 0.15 | 0.32 | 0.86 |
| 22 | 0.13 | 1.34 | 0.01 | 0.30 | 0.15 | 0.20 | 1.07 |
| 23 | 0.13 | 1.34 | 0.01 | 0.30 | 0.15 | 0.17 | 1.13 |
| 24 | 0.13 | 1.34 | 0.01 | 0.30 | 0.15 | 0.10 | 1.32 |
| 25 | 0.24 | 1.34 | 0.01 | 0.05 | 0.03 | 0.75 | 1.26 |
| 26 | 0.24 | 1.34 | 0.01 | 0.05 | 0.03 | 1.0 | 0.96 |
| 27 | 0.24 | 1.34 | 0.01 | 0.05 | 0.03 | 1.3 | 0.75 |
| 28 | 0.15 | 1.34 | 0.01 | 0.60 | 0.15 | 0.32 | 0.80 |
| 29 | 0.15 | 1.34 | 0.01 | 0.40 | 0.15 | 0.32 | 0.92 |
| 30 | 0.15 | 1.34 | 0.01 | 0.30 | 0.15 | 0.32 | 1.00 |
| 31 | 0.15 | 1.34 | 0.01 | 0.15 | 0.15 | 0.32 | 1.14 |
| 32 | 0.15 | 1.34 | 0.01 | 0.03 | 0.15 | 0.32 | 1.29 |
| 33 | 0.15 | 1.34 | 0.01 | 0.29 | 0.23 | 0.32 | 0.89 |
| 34 | 0.15 | 1.34 | 0.01 | 0.30 | 0.18 | 0.32 | 0.95 |
| 35 | 0.15 | 1.34 | 0.01 | 0.30 | 0.08 | 0.32 | 1.13 |
| 36 | 0.15 | 1.34 | 0.01 | 0.30 | 0.02 | 0.32 | 1.27 |
| 37 | 0.05 | 1.34 | 0.01 | 0.06 | 0.03 | 0.15 | 0.99 |
| 38 | 0.09 | 1.34 | 0.01 | 0.13 | 0.06 | 0.25 | 1.00 |
| 39 | 0.12 | 1.34 | 0.01 | 0.17 | 0.08 | 0.33 | 1.01 |
| 40 | 0.20 | 1.34 | 0.01 | 0.28 | 0.14 | 0.56 | 0.99 |
| 41 | 0.25 | 1.34 | 0.01 | 0.36 | 0.18 | 0.68 | 1.00 |
| 42 | 0.14 | 1.34 | 0.01 | 0.16 | 0.08 | 0.20 | 1.61 |
| 43 | 0.14 | 1.34 | 0.01 | 0.21 | 0.11 | 0.26 | 1.22 |
| 44 | 0.14 | 1.34 | 0.01 | 0.26 | 0.13 | 0.32 | 1.00 |
| 45 | 0.14 | 1.34 | 0.01 | 0.32 | 0.16 | 0.39 | 0.82 |
| 46 | 0.14 | 1.34 | 0.01 | 0.40 | 0.20 | 0.50 | 0.64 |
| 47 | 0.15 | 0.6 | 0.01 | 0.30 | 0.15 | 0.32 | 1.00 |
| 48 | 0.15 | 1.1 | 0.01 | 0.30 | 0.15 | 0.32 | 1.00 |
| 49 | 0.15 | 1.9 | 0.01 | 0.30 | 0.15 | 0.32 | 1.00 |
| 50 | 0.15 | 1.34 | 0.05 | 0.30 | 0.15 | 0.32 | 1.00 |

*A value: (C/12)/{(Ti/48) + (Mo/96) + (V/51)}

TABLE 7

| Steel No. | Microstructure* | Fine carbide: Average particle size (nm) | Fine carbide: V fraction** (atomic ratio) | Fine carbide: Ti:Mo:V (atomic ratio) | TS (MPa) | EI (%) | λ (%) |
|---|---|---|---|---|---|---|---|
| 21 | F | 3 | 0.48 | 1.1:1.0:1.9 | 1186 | 17.6 | 36 |
| 22 | F | 3 | 0.44 | 1.1:1.2:1.7 | 1124 | 19.2 | 41 |
| 23 | F | 4 | 0.36 | 1.3:1.3:1.4 | 1107 | 19.8 | 42 |
| 24 | F | 4 | 0.24 | 1.5:1.5:1.0 | 972 | 20.1 | 48 |
| 25 | F | 4 | 0.56 | 0.9:0.9:2.2 | 1201 | 17.6 | 38 |
| 26 | F | 4 | 0.52 | 1.0:0.9:2.1 | 1208 | 17.5 | 38 |
| 27 | F | 5 | 0.47 | 1.1:1.0:1.9 | 985 | 10.2 | 19 |
| 28 | F | 4 | 0.41 | 1.3:1.0:1.7 | 982 | 14.1 | 21 |
| 29 | F | 3 | 0.45 | 1.3:0.9:1.8 | 1192 | 17.9 | 37 |
| 30 | F | 3 | 0.52 | 1.0:0.9:2.1 | 1185 | 18.0 | 36 |
| 31 | F | 4 | 0.54 | 1.1:0.7:2.2 | 1181 | 18.1 | 37 |
| 32 | F | 12 | 0.50 | 1.5:0.5:2.0 | 951 | 22.6 | 52 |

TABLE 7-continued

| Steel No. | Microstructure* | Fine carbide: Average particle size (nm) | Fine carbide: V fraction** (atomic ratio) | Fine carbide: Ti:Mo:V (atomic ratio) | TS (MPa) | EI (%) | λ (%) |
|---|---|---|---|---|---|---|---|
| 33 | F | 13 | 0.37 | 1.5:1.0:1.5 | 947 | 22.1 | 53 |
| 34 | F | 3 | 0.42 | 1.2:1.1:1.7 | 1146 | 20.8 | 41 |
| 35 | F | 4 | 0.47 | 0.9:1.2:1.9 | 1191 | 17.8 | 37 |
| 36 | F | 5 | 0.36 | 0.6:2.0:1.4 | 957 | 22.2 | 46 |
| 37 | F | 3 | 0.38 | 1.2:1.2:1.6 | 827 | 24.0 | 98 |
| 38 | F | 4 | 0.52 | 0.9:1.0:2.1 | 1142 | 19.9 | 39 |
| 39 | F | 3 | 0.48 | 1.0:1.0:2.0 | 1199 | 18.1 | 38 |
| 40 | F | 3 | 0.49 | 0.9:1.1:2.0 | 1201 | 17.6 | 35 |
| 41 | F + P | 8 | 0.51 | 0.9:1.0:2.1 | 944 | 22.3 | 47 |
| 42 | F | 5 | 0.41 | 1.2:1.1:1.7 | 874 | 22.5 | 87 |
| 43 | F | 3 | 0.48 | 1.0:1.1:1.9 | 1187 | 17.1 | 38 |
| 44 | F | 3 | 0.51 | 1.0:0.9:2.1 | 1191 | 17.1 | 32 |
| 45 | F | 3 | 0.54 | 0.9:0.9:2.2 | 1210 | 17.0 | 36 |
| 46 | F | 3 | 0.47 | 1.2:0.9:1.9 | 955 | 21.6 | 51 |
| 47 | F | 3 | 0.46 | 1.1:1.1:1.8 | 983 | 14.1 | 36 |
| 48 | F | 3 | 0.45 | 1.1:1.1:1.8 | 1137 | 17.6 | 34 |
| 49 | F | 4 | 0.48 | 1.1:1.0:1.9 | 1258 | 17.2 | 33 |
| 50 | F | 4 | 0.44 | 1.2:1.1:1.7 | 1203 | 17.3 | 33 |

*Microstructure: F means ferrite, P means pearlite, and M means martensite.
**V fraction = V/(Ti + Mo + V)

INDUSTRIAL APPLICABILITY

The present invention provides a highly formable high tensile steel sheet by adding V at a suitable balance, adding to Ti and Mo, thus letting the fine carbide containing Ti, Mo, and V precipitate in dispersed state.

The present invention thus provides high tensile steel sheet having 980 MPa or higher strength, giving both excellent elongation and stretch-flange formability, which are indexes of formability. That type of steel sheet is suitable for the press-forming of complex cross sectional shape, such as automobile parts.

The invention claimed is:

1. A high tensile steel sheet comprising more than 0.11% and not more than 0.24% C, 0.3% or less Si, 0.5 to 2.0% Mn, 0.06% or less P, 0.005% or less S, 0.06% or less Al, 0.006% or less N, 0.05 to 0.5% Mo, 0.03 to 0.2% Ti, more than 0.20% and not more than 1.2% V, by mass, and a balance of Fe and inevitable impurities, and consisting essentially of a ferrite single phase structure, having a tensile strength of 1100 MPa or higher, wherein the steel contains a carbide containing Ti, Mo, and V, and having smaller than 10 nm of an average particle size precipitates in a dispersed state, and the carbide containing Ti, Mo, and V has an average composition satisfying [V/(Ti+Mo+V)≧0.3], wherein Ti, Mo, and V are expressed by atomic %.

2. The high tensile steel sheet according to claim 1, wherein the average composition of the carbide satisfies a=0.6 to 1.4, b=0.6 to 1.4, and c=1.4 to 2.8, while a+b+c=4, where a:b:c is the atomic ratio of Ti:Mo:V.

3. The high tensile steel sheet according to claim 1 having a composition in which the content of C, Ti, Mo, and V satisfies the following formula (I), $$0.8 \leqq (C/12)/\{(Ti/48)+(Mo/96)+(V/51)\} \leqq 1.5 \quad (I)$$

wherein C, Ti, Mo, and V designate the % by mass for each of C, Ti, Mo and V.

4. A high tensile steel sheet comprising more than 0.11% and not more than 0.24% C, 0.3% or less Si, 0.5 to 2.0% Mn, 0.06% or less P, 0.005% or less S, 0.06% or less Al, 0.006% or less N, 0.05 to 0.5% Mo, 0.03 to 0.2% Ti, more than 0.20% and not more than 1.2% V, by mass, and balance of Fe and inevitable impurities, and having a composition in which the content of C, Ti, Mo, and V satisfies the following formula (I), $$0.8 \leqq (C/12)/\{(Ti/48)+(Mo/96)+(V/51)\} \leqq 1.5 \quad (I)$$

wherein C, Ti, Mo, and V designate the % by mass for each of C, Ti, Mo and V, wherein the steel contains dispersed carbides having an average carbide composition containing Ti, Mo and V and satisfies a=0.6 to 1.4, b=0.6 to 1.4, and c=1.4 to 2.8, while a+b+c=4, where a:b:c is the atomic ratio of Ti:Mo:V.

5. The high tensile steel sheet according to claim 1, wherein the steel sheet is a thin gauge hot-rolled steel sheet having 2.5 mm or smaller sheet thickness.

6. The high tensile steel sheet according to claim 1, wherein the steel sheet has a hot-dip galvanized film thereon.

7. A method for manufacturing high tensile steel sheet giving 1100 MPa or higher tensile strength, comprising the steps of hot rolling and coiling a steel slab comprising more than 0.11% and not more than 0.24% C, 0.3% or less Si, 0.5 to 2.0% Mn, 0.06% or less P, 0.005% or less S, 0.06% or less Al, 0.006% or less N, 0.05 to 0.5% Mo, 0.03 to 0.2% Ti, more than 0.20% and not more than 1.2% V, by mass, and a balance of Fe and inevitable impurities, and having a composition in which the content of C, Ti, Mo, and V satisfies the following formula (I), under conditions of a hot rolling finishing temperature of 880° C. or higher and a coiling temperature of 570° C. or higher $$0.8 \leqq (C/12)/\{(Ti/48)+(Mo/96)+(V/51)\} \leqq 1.5 \quad (I)$$

wherein C, Ti, Mo, and V designate the % by mass for each of C, Ti, Mo and V.

8. The method for manufacturing a high tensile steel sheet according to claim 7, further comprising the step of hot-dip galvanizing onto the surface of the steel sheet after the hot-rolling.

9. The high tensile steel sheet according to claim 2, wherein the steel sheet is a thin gauge hot-rolled steel sheet having 2.5 mm or smaller sheet thickness.

10. The high tensile steel sheet according to claim 3, wherein the steel sheet is a thin gauge hot-rolled steel sheet having 2.5 mm or smaller sheet thickness.

11. The high tensile steel sheet according to claim 4, wherein the steel sheet is a thin gauge hot-rolled steel sheet having 2.5 mm or smaller sheet thickness.

12. The high tensile steel sheet according to claim 2, wherein the steel sheet has a hot-dip galvanized film thereon.

13. The high tensile steel sheet according to claim 3, wherein the steel sheet has a hot-dip galvanized film thereon.

14. The high tensile steel sheet according to claim 4, wherein the steel sheet has a hot-dip galvanized film thereon.

* * * * *